US009110437B2

(12) United States Patent
Saito et al.

(10) Patent No.: US 9,110,437 B2
(45) Date of Patent: Aug. 18, 2015

(54) SHEET PROCESSING APPARATUS WITH MOVABLE HEATING UNIT

(71) Applicants: Kabushiki Kaisha Toshiba, Tokyo (JP); Toshiba Tec Kabushiki Kaisha, Tokyo (JP)

(72) Inventors: Yuichi Saito, Shizuoka-ken (JP); Hiroyuki Tsuchihashi, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/169,529

(22) Filed: Jan. 31, 2014

(65) Prior Publication Data

US 2014/0212187 A1 Jul. 31, 2014

(30) Foreign Application Priority Data

Jan. 31, 2013 (JP) ..... 2013-017728

(51) Int. Cl.
*G03G 15/20* (2006.01)
*G03G 21/16* (2006.01)

(52) U.S. Cl.
CPC ..... *G03G 21/1685* (2013.01); *G03G 21/1647* (2013.01)

(58) Field of Classification Search
CPC ..... G03G 15/2028; G03G 21/1647; G03G 21/1685
USPC ..... 399/122, 322
See application file for complete search history.

(56) References Cited

U.S. PATENT DOCUMENTS

| | | | | |
|---|---|---|---|---|
| 4,760,411 | A * | 7/1988 | Ohmura et al. | 347/156 |
| 7,164,878 | B2 * | 1/2007 | Yamanaka | 399/122 |
| 8,688,005 | B2 * | 4/2014 | Nozawa | 399/122 |
| 2003/0219277 | A1 * | 11/2003 | Mikita et al. | 399/122 |
| 2006/0140675 | A1 * | 6/2006 | Kim et al. | 399/122 |
| 2007/0025764 | A1 * | 2/2007 | Maeda | 399/122 |
| 2007/0059036 | A1 * | 3/2007 | Yamada et al. | 399/116 |
| 2008/0101826 | A1 * | 5/2008 | Shiga et al. | 399/322 |
| 2008/0240781 | A1 * | 10/2008 | Murano | 399/122 |

(Continued)

FOREIGN PATENT DOCUMENTS

| | | |
|---|---|---|
| JP | 2001-206562 | 7/2001 |
| JP | 2005-266157 | 9/2005 |
| JP | 2010-002622 | 1/2010 |
| JP | 2010-002710 | 1/2010 |

OTHER PUBLICATIONS

Machine translation of JP 2010002622 A.*

(Continued)

*Primary Examiner* — David Bolduc
(74) *Attorney, Agent, or Firm* — Patterson & Sheridan, LLP

(57) ABSTRACT

A sheet processing apparatus comprises a heating unit configured to heat a sheet when the sheet is conveyed between a pair of rollers, a first guide unit that supports and guides movement of the heating unit in a first direction towards a predetermined position exterior to the sheet processing apparatus, and a second guide unit that supports and guides further movement of the heating unit in the first direction in cooperation with the first guide unit, the second guide unit including an abutment section configured to stop movement of the heating unit in the first direction when the heating unit reaches the predetermined position.

18 Claims, 8 Drawing Sheets

(56) References Cited

U.S. PATENT DOCUMENTS

| | | | | |
|---|---|---|---|---|
| 2009/0245865 | A1* | 10/2009 | Shinshi et al. | 399/122 |
| 2009/0263155 | A1* | 10/2009 | Murano | 399/107 |
| 2010/0034559 | A1* | 2/2010 | Sahara | 399/122 |
| 2010/0329729 | A1* | 12/2010 | Koshida | 399/110 |
| 2011/0243607 | A1* | 10/2011 | Takahashi | 399/122 |
| 2013/0002782 | A1 | 1/2013 | Kawaguchi et al. | |
| 2013/0230335 | A1 | 9/2013 | Hiura et al. | |

OTHER PUBLICATIONS

Machine translation of JP 2010002710 A.*

Office Action dated Aug. 19, 2014, filed in Japanese Patent Application No. 2013-017728, with English translation.

* cited by examiner

SHEET PROCESSING APPARATUS WITH MOVABLE HEATING UNIT

CROSS-REFERENCE TO RELATED APPLICATION

This application is based upon and claims the benefit of priority from Japanese Patent Application No. 2013-017728, filed Jan. 31, 2013, the entire contents of which are incorporated herein by reference.

FIELD

Embodiments described herein relate to a sheet processing apparatus which comprises a heating apparatus used in a fixing device for fixing a visualized image with a developing material, that is, a color material, on a sheet and used in an erasing apparatus for erasing the color of the visualized image.

BACKGROUND

A sheet processing apparatus is known which comprises a heating apparatus used in a fixing device for fixing a visualized image with a developing material, that is, a color material, on a sheet and used in an erasing apparatus for erasing the color of the visualized image to reuse the sheet.

Generally, the heating apparatus comprises a heating mechanism including, for example, a heat roller having a heat source and a press roller for pressing a sheet having the color material against the heat roller as the sheet is conveyed, to thereby carry out heating processing on the sheet.

DETAILED DESCRIPTION

A sheet processing apparatus according to an embodiment includes a heating unit configured heat a sheet when the sheet is conveyed between a pair of rollers. A first guide unit supports and guides movement of the heating unit in a first direction towards a predetermined position exterior to the sheet processing apparatus. A second guide unit supports and guides further movement of the heating unit in the first direction in cooperation with the first guide unit and including an abutment section configured to stop movement of the heating unit in the first direction when the heating unit reaches the predetermined position.

Embodiments of the present invention are described below with reference to accompanying drawings.

Figure 1:
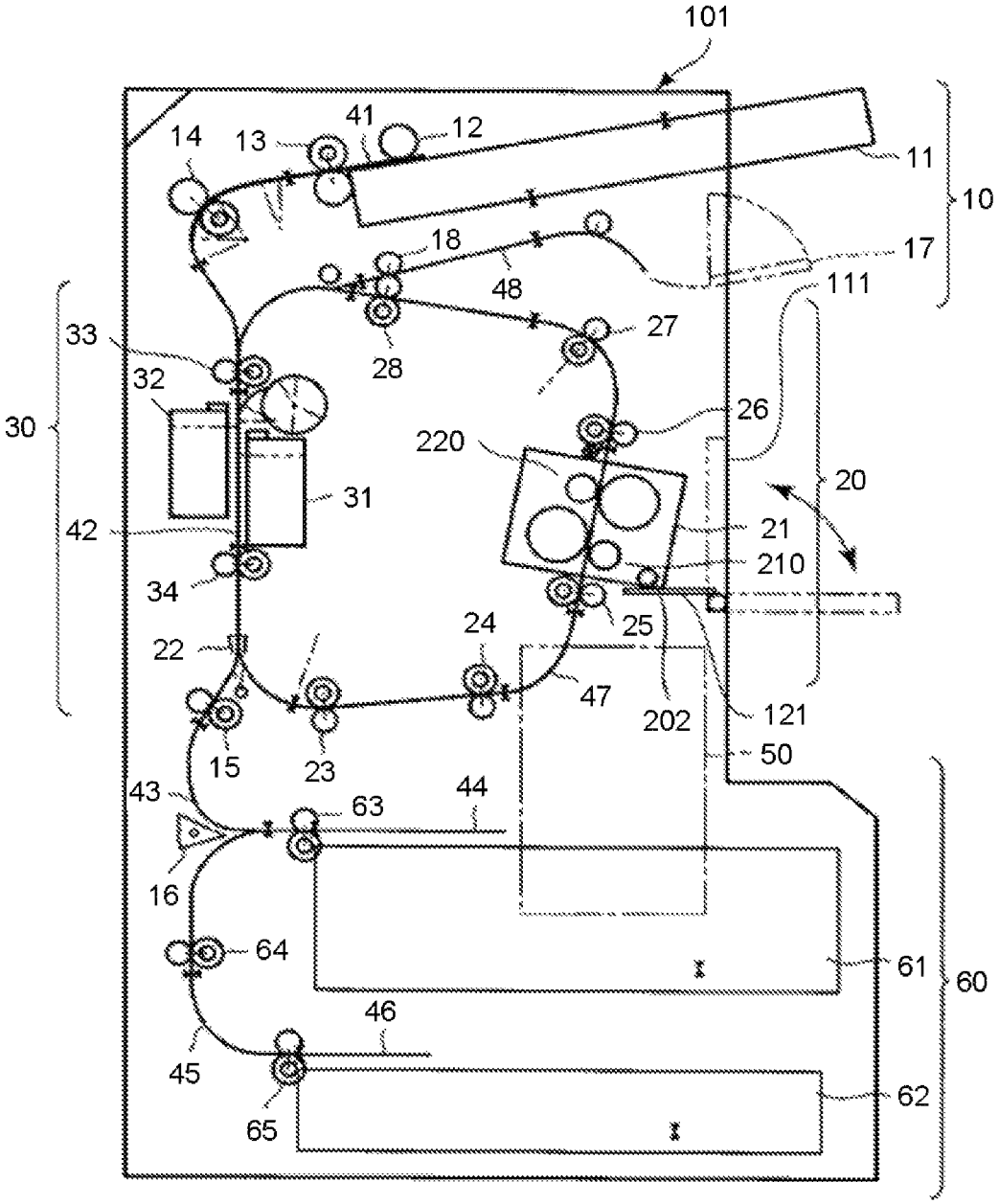
FIG. 1 shows an example of a sheet processing apparatus of an embodiment.
Figure 2:
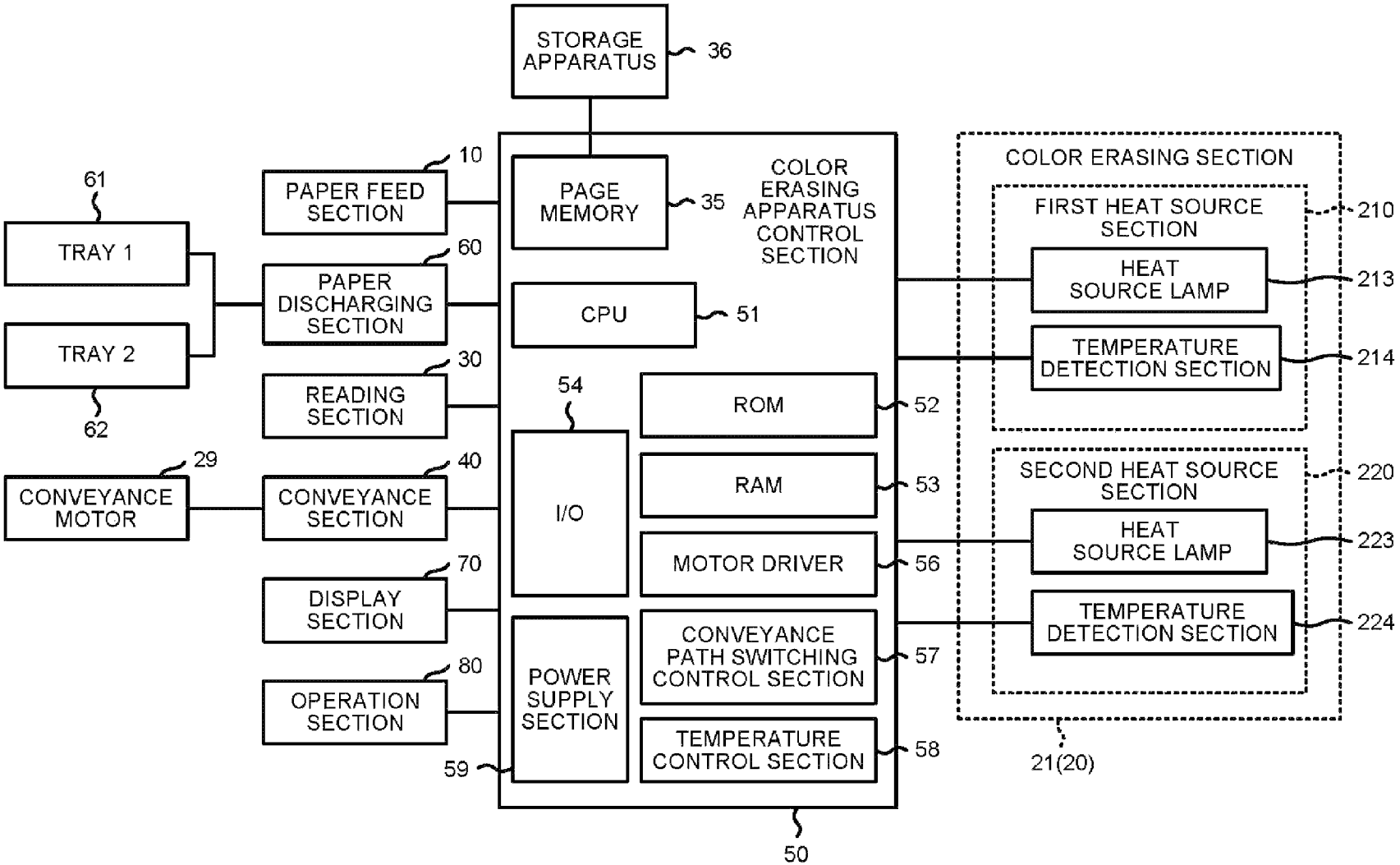
FIG. 2 shows an example of the main components of the sheet processing apparatus.

The sheet processing apparatus 101 shown in FIG. 1 and FIG. 2 includes a paper feed section 10, an erasing section 20, a reading section 30, a conveyance section 40, a color erasing apparatus control section 50, a paper discharging section 60, a display section 70 and an operation section 80. Further, FIG. 2 is a block diagram illustrating the sheet processing apparatus 101. FIG. 1 is a schematic diagram illustrating the sheet processing apparatus 101 that conveys a sheet (paper) and circulates the sheet through an erasing section. Further, the sheet processing apparatus 101 is an example of an erasing apparatus which erases the color of an image formed with an erasable color material such as an erasable toner, to reuse a sheet.

The paper feed section 10 includes a pre-decolorization sheet holding section (hereinafter referred to as a paper feed cassette) 11 configured to receive a pre-decolorization sheet on which there is an image that may be subject to the color erasing; a conveyance path 41 on which a pre-decolorization sheet held by the paper feed cassette 11 is guided to the erasing section 20 which will be described later in detail; a paper feed roller 12 configured to apply, to the pre-decolorization sheet, a conveyance force capable of conveying the pre-decolorization sheet based on the conveyance path 41; a conveyance roller 13; and a conveyance roller 14.

The conveyance path 41 is connected with the reading section 30 which will be described later in detail and is connected with a conveyance path 42 which is partially shared with the conveyance path 41.

The conveyance path 42 guides the pre-decolorization sheet which will be guided towards the erasing section 20 or a sheet after decolorization (hereinafter referred to as a color-erased sheet) to an erasing sheet holding section 60 (hereinafter referred to as a paper discharging section). The conveyance path 42 includes conveyance rollers 33 and 34 for applying the propulsion force capable of conveying a sheet based on the conveyance path 42 to a pre-decolorization sheet and a color-erased sheet.

The erasing section 20 includes a branching device 22 configured to branch a pre-decolorization sheet from the conveyance path 42 to a color erasing apparatus 21, based on the reading result obtained by the reading section 30 which will be described below; a conveyance path 47 on which the pre-decolorization sheet branched by the branching device 22 is guided to the color erasing apparatus 21; conveyance rollers 23-25 configured to convey the pre-decolorization sheet to the color erasing apparatus 21; and conveyance rollers 26-28 configured to guide a color-erased sheet after decolorization with the color erasing apparatus 21 to the conveyance path 42. The color erasing apparatus 21 includes a first heating unit 210 and a second heating unit 220. Each heating unit 210 and 220 are configured to provide heat to the sheet passing between a pair of rollers to erase the color of the sheet. The color erasing apparatus 21 will be described in detail later with reference to FIG. 3. Further, a gate 111 (which is opened when replacing the color erasing apparatus 21) is positioned at a specific position relative to the sheet processing apparatus 101 nearby the color erasing apparatus 21. The gate 111 can be opened or closed through an opening/closing operation in the arrow direction, with a pivot point 101*a* as a rotation center. Further, the color erasing apparatus 21 moves along a rail 121 which is positioned between the color erasing apparatus 21 and the gate 111.

The reading section 30 includes a first and a second image sensor 31 and 32 for detecting whether or not a sheet passing through the conveyance path 42 is a pre-decolorization sheet. The first and the second image sensor 31 and 32, which are, for example, reflection density sensors or dielectric measurement sensors, detect whether or not there are images on two sides of a sheet passing through the conveyance path 42.

Further, the first and the second image sensors 31 and 32 of the reading section 30 are, for example, CMOS sensors for obtaining the image information of a sheet passing through the conveyance path 42. The image information obtained by the image sensors 31 and 32 is held in a storage apparatus 36. With a page memory 35, the image information held in the storage apparatus 36 is subjected to an A-D (Analog-Digital) conversion to become a page unit.

The conveyance path 42 is connected with a conveyance path 43 for guiding a color-erased sheet branched by the branching device 22 to the paper discharging section 60.

The conveyance path 43 includes a paper-discharging branching device 16 and a conveyance roller 15 for guiding a color-erased sheet branched by the branching device 22 to either of a reuse cassette 61 and a reject cassette 62 of the paper discharging section 60. The sheet is guided to the reuse cassette 61 by a conveyance roller 63 and the conveyance path 44 (conveyance section) 40. Further, the sheet is guided to the reject cassette 62 by conveyance rollers 63-65 and conveyance paths 45-46 (conveyance section 40).

Further, a manual conveyance path 48 is connected at a position where a sheet can be fed to the conveyance path 42. For example, the manual conveyance path 48 may be positioned at, with respect to the conveyance path 42, a position at the upstream side of the conveyance path 41 for conveying a sheet fed from the paper feed cassette 11, or at a position at the upstream side of the conveyance path 47 for conveying a color-erased sheet the color of which is erased by the color erasing apparatus 21 to the conveyance path 42. The manual conveyance path 48 includes a manual paper feeding section 17 and a conveyance roller 18 for feeding a pre-decolorization sheet to the color erasing apparatus 21, that is, the erasing section 20, by bypassing the paper feed cassette 11.

The control section 50 includes, for example, a CPU (Central Processing Unit, main control device)51, a ROM (Read Only Memory, read-only memory) 52, a RAM (Random Access Memory, rewritable memory) 53, an input/output (I/O) port 54, a motor driver 56, a conveyance path switching control section (branching device driver section) 57, a temperature control section 58 and a power supply section 59. Further, the display section 70 and the operation section 80 are connected with the control section 50. Further, the display section 70 and the operation section 80 may be integrally formed using, for example, a touch panel.

The main control device (CPU) 51 controls the operations of each section according to operation programs held in the ROM 52.

The ROM 52 holds an operation program for controlling functions of the color erasing apparatus 21 and reference values for a comparison with the detection results based on the first and the second image sensors 31 and 32.

The RAM 53 receives the detection results according to the first and the second image sensors 31 and 32 input through the I/O port 54 and the input from JAM sensors prepared at specific positions of the conveyance paths 41-48 (conveyance section 40) input through the I/O port 54. The RAM 53 also holds the temporary data when executing a processing routine according to the instruction input (operation information) of the operation section 80.

The I/O port 54 translates the detection results of the first and the second image sensors 31 and 32 into a form processable by the CPU 51. Further, the I/O port 54 translates an instruction input from the operation section 80 into a form processable by the CPU 51. Further, the I/O port 54 also contributes to receiving a control instruction given to various components included in the paper feed section 10, the erasing section 20, the reading section 30, the conveyance section 40 and the paper discharging section 60. For example, control instructions may be given to a motor or the branching device, and the detection value detected by any sensor may be provided to a unit as needed.

The motor driver 56 drives the conveyance motor 29 for driving the conveyance rollers 23-28 located at the upstream side and at the downstream side of the color erasing apparatus 21 or any roller of each section excluding motors.

The paper discharging section 60 guides a sheet after decolorization through the conveyance path 43 illustrated in FIG. 1 to either of the reuse cassette 61 and the reject cassette 62 through the branching device 16.

The operation section 80 accepts the input of a control instruction from a user and outputs a control command corresponding to the control instruction in a form readable by the CPU 51.

The color erasing apparatus 21 is located at a specific position of the second conveyance path which refers to the conveyance path 47 branched away from the first conveyance path at the reading section 30. A first conveyance path, which is already illustrated in FIG. 1, starts from the paper feed cassette 11, passes through the conveyance path 41, the conveyance path 42 (reading section 30), the conveyance path 43 and the conveyance path 44 (paper discharging section 60) and ends at either of the reuse cassette 61 and the reject cassette 62.

Figure 3:
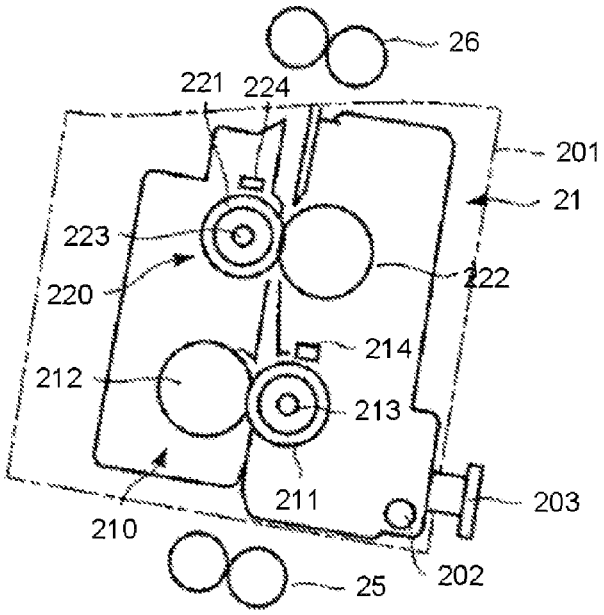
FIG. 3 shows an example of the heating apparatus of the sheet processing apparatus.

As shown in FIG. 3, the color erasing apparatus 21 comprises a heating unit 210 and a second heating unit 220. Further, the side of the conveyance rollers 23-25 of the second conveyance path, that is, the conveyance path 47, is referred to as an upstream conveyance side. The side of the conveyance rollers 26-28 of the second conveyance path, that is, the conveyance path 47, is referred to as a downstream conveyance side.

The first heating unit 210 (at the upstream conveyance side) includes a heat roller 211 and a press roller 212 in a pair. The heat roller 211 has a heat source lamp 213 therein and a temperature detection section 214 in the outer periphery.

The second heating unit 220 (at the downstream conveyance side) includes a heat roller 221 and a press roller 222 in a pair. The heat roller 221 has a heat source lamp 223 therein and a temperature detection section 224 in the outer periphery.

The heat capacity of the heat source lamp 213 of the heat roller 213 of the first heating unit 210 is substantially equal to that of the heat source lamp 223 of the heat roller 221 of the second heating unit 220.

In the first heating unit 210 and the second heating unit 220, the heat rollers 211 and 221 are arranged reversed to the second conveyance path. In the arrangement described in the embodiment, the heat roller 211 is connected with one side (corresponding to the side of the second image sensor 32, which is hereinafter referred to as a front surface as needed) of a sheet passing through the second conveyance path. The heat roller 221 is connected with the other side (corresponding to the side of the first image sensor 31, which is hereinafter referred to as a back surface as needed) of the sheet passing through the second conveyance path.

One or both of the first heating unit 210 and the second heating unit 220 can form a nip formed with an endless belt and a heat roller. The heat source lamp 213 of the first heating unit 210 or the heat source lamp 223 of the second heating unit 220 may be an IH (Induction heating) heater for enabling the metal surface (or a metal layer of a belt) of the heat roller to generate induction heat.

Further, the color erasing apparatus 21 has a cover 201 positioned around the first heating unit 210 and the second heating unit 220 to maintain internal temperature while keeping external temperature below a safe temperature. A stud (guide pin) 202 for facilitating the movement of the color erasing apparatus 21 when replacing the color erasing apparatus 21 and a handle 203 for facilitating the replacement of the color erasing apparatus 21 are arranged on the cover 201 at the side of the heat roller 211 of the first heating unit 210.

A conveyance operation is now described.

In a color erasing and reading mode, a sheet having an image formed with a color material which is to be erased is fed from the paper feed section 10 through the first conveyance path and then is located at the reading section 30.

In the reading section 30, the first and the second image sensors 31 and 32 read the image information on the sheet. The image information read by the image sensors 31 and 32 on the sheet is held in the storage apparatus 36.

The sheet passing through the reading section 30 is conveyed through the second conveyance path (conveyance path 47) and reaches the first heating unit 210 of the color erasing apparatus 21 via the conveyance roller 25 at the upstream conveyance side. A color erasing processing in which the color of the image is erased is carried out during the period when the sheet passed along the first heating unit 210 and the second heating unit 220 at the downstream conveyance side.

The color-erased sheet is conveyed to the second conveyance path via the conveyance roller 26 at the downstream conveyance side of the second heating unit 220.

The color-erased sheet on the second conveyance path is conveyed to the first conveyance path again and then conveyed to the first paper discharging tray (reuse cassette) 61 or the second paper-discharging tray (reject cassette) 62 of the discharging section 60 through the first conveyance path.

The procedure for replacing the heating apparatus, that is, the color erasing apparatus, and the characteristics of the structure of the sheet processing apparatus facilitating the replacement are now described in connection with FIGS. 4-6.

Figure 4:
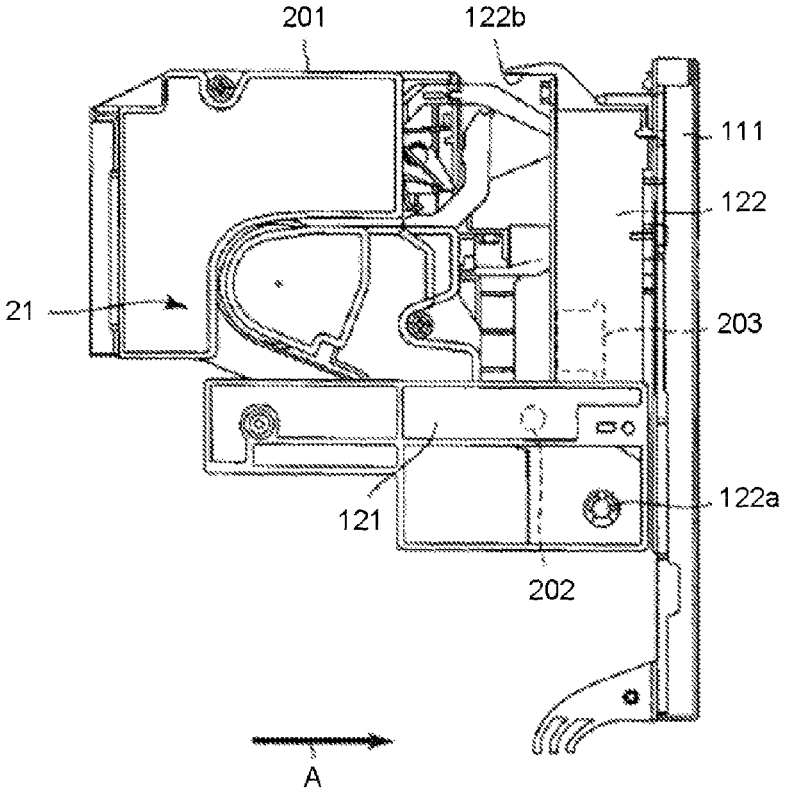
FIG. 4 shows an example of a guide mechanism of the heating apparatus.

FIG. 4 shows a state in which the color erasing apparatus 21 of the sheet processing apparatus 101 shown in FIG. 1 and the guide mechanism supporting the color erasing apparatus 21 are drawn out. FIG. 5 shows a state in which an auxiliary rail 122 is rotated 90 degrees from the position in FIG. 4. The cover 111 shown in FIG. 4 nearby the color erasing apparatus 21 has been removed in FIG. 5 and is saved.

As shown in FIG. 4, the color erasing apparatus 21 is positioned on the rail 121 (the guide mechanism), at a specific position in the sheet processing apparatus 101. Further, FIG. 4 shows a state in which the color erasing apparatus 21 cannot be moved because the cover (gate) 111 is closed. Further, in FIG. 4, the cover 111 can be opened to move the color erasing apparatus 21 towards the arrow A direction.

The auxiliary rail 122, which is connected with the rail 121, can be rotated 90 degrees by taking the pivot point 122*a* as a rotation center when the cover 111 is opened. The auxiliary rail 122 has an abutment section 122*b* for contacting the stud (guide pin) 202 of the color erasing apparatus 21 when the color erasing apparatus 21 has slid in the direction A.

If the cover 111 is opened, then the auxiliary rail 122 can be rotated in arrow B direction. Thus, as shown in FIG. 5, the color erasing apparatus 21 can be moved on the rail 121 and the auxiliary rail 122 along the arrow A direction. Further, the arrow A direction in which the rail 121 and the spread auxiliary rail 122 extend is a horizontal direction orthogonal to a direction of gravity.

Figure 5:
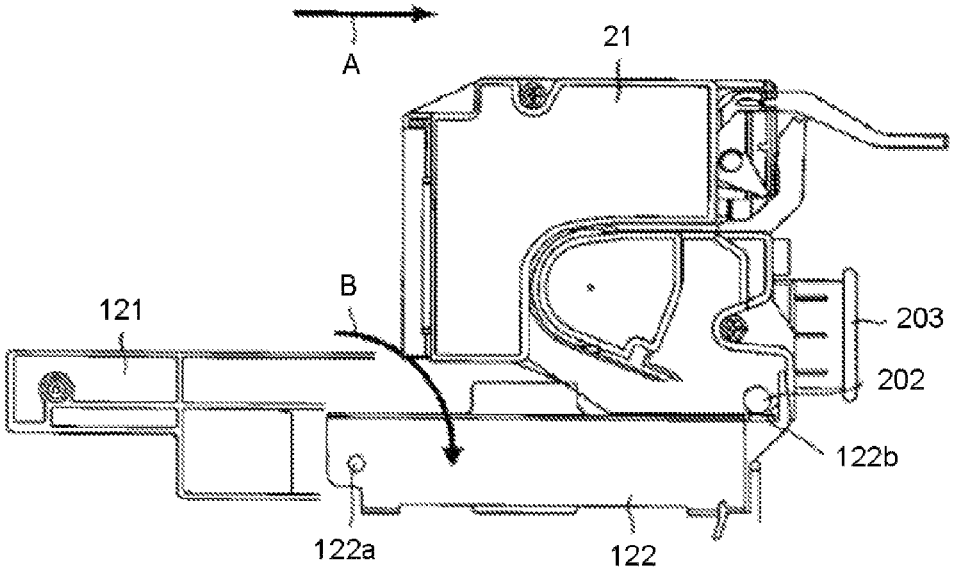
FIG. 5 shows another example of the guide mechanism of the heating apparatus.

As shown in FIG. 5, the color erasing apparatus 21 moving on the auxiliary rail 122 is stopped by contacting the stud 202 with the abutment section 122*b* at the position of the abutment section 122*b* (no further movement in the arrow A direction beyond the abutment section 122*b*).

Figure 6:
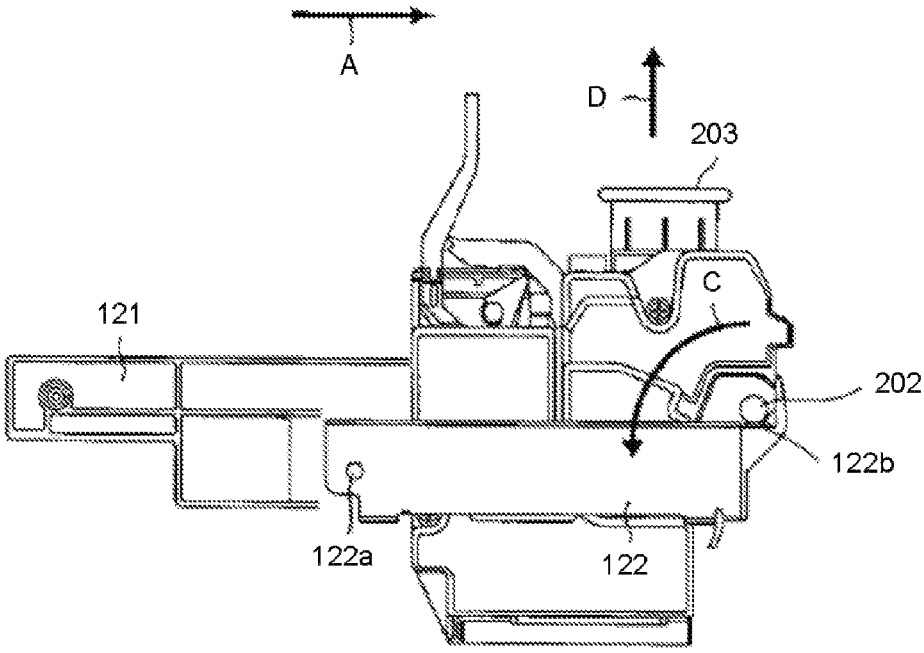
FIG. 6 shows another example of the guide mechanism of the heating apparatus.

FIG. 6 shows the operations of the color erasing apparatus 21 on the spread auxiliary rail 122 shown in FIG. 5.

The color erasing apparatus 21, stopped against the abutment section 122*b* on the auxiliary rail 122, rotates about 90 degrees by its own weight taking the stud 202 as a rotation center in the gravity direction, that is, the arrow C direction, as shown in FIG. 6. That is, in order to make the handle 203 face in the arrow D direction (which is orthogonal to the arrow A direction in which the rail 121 and the spread auxiliary rail 122 extend and is reverse to the gravity direction), the color erasing apparatus 21 swivels about 90 degrees. Thus, the color erasing apparatus 21 can be easily drawn out in a draw-out direction. That is, the movement of a heavy object in the vertical direction, such as the arrow D direction, is favorable compared to the movement in a horizontal direction (the arrow A direction). Thus, the weight felt by an operator (user) detaching the color erasing apparatus 21 is reduced.

Figure 7:
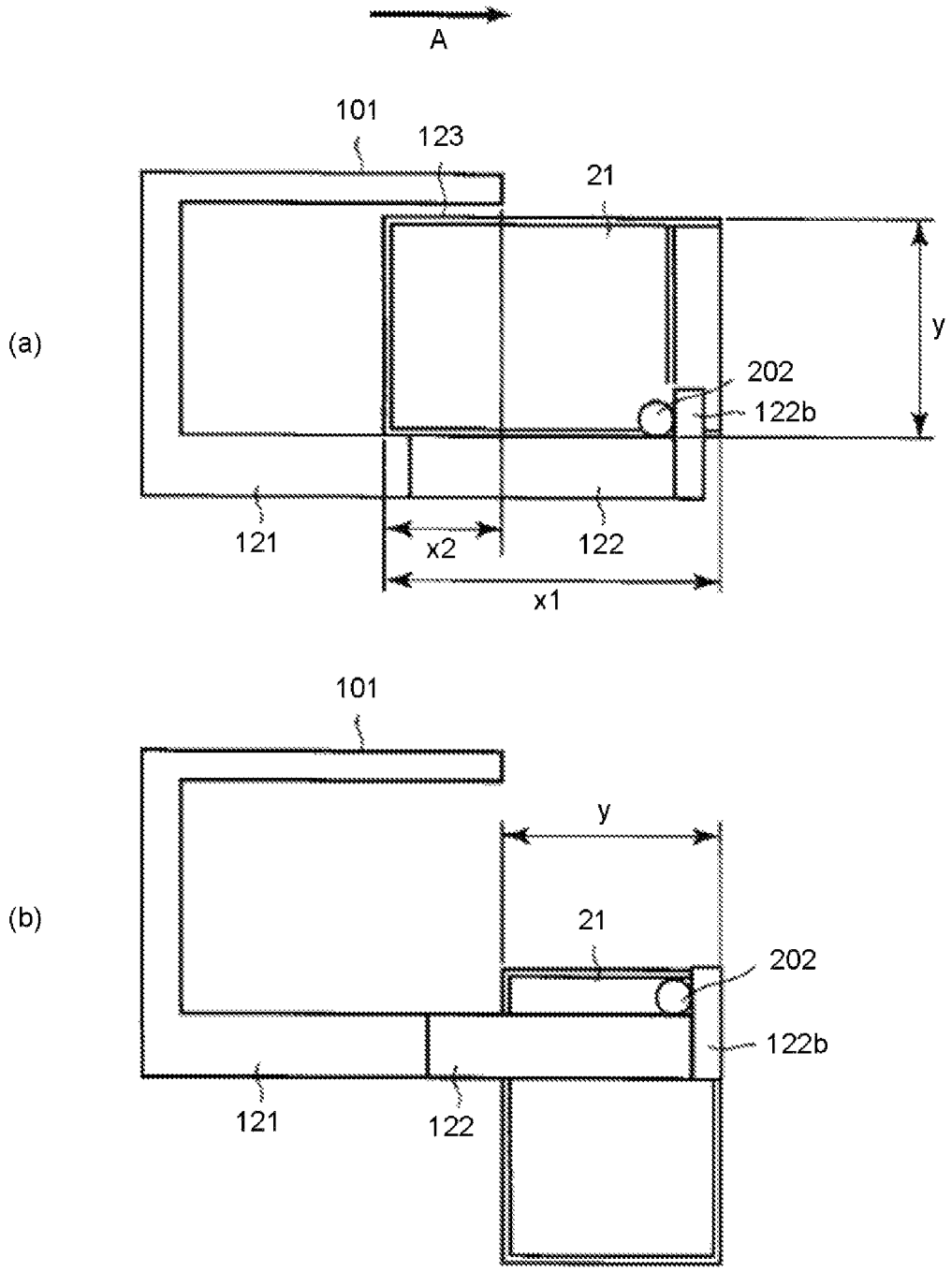
FIG. 7 shows another example of the guide mechanism of the heating apparatus.

The distance between the pivot point 122*a* and the abutment section 122*b* of the spread auxiliary rail 122 is x1, which is set based on a jump-out prevention distance x2 which is compared with the height direction y of the color erasing apparatus 21 as shown in FIG. 7(*a*) and FIG. 7(*b*). The relationship between x1, x2 and y meets the following formulae:

$$x1-x2>y$$

$$x2<y<x1$$

The jump-out prevention distance x2 is the distance between the position of the external shape where the cover 111 of the sheet processing apparatus 101 is closed and the pivot point 122*a* of the auxiliary rail 122.

That is, by associating the distance x1 from the pivot point 122*a* to the stud 122*b* of the auxiliary rail 122 with the jump-out prevention distance x2 and specifying the distances, in the case in which the color erasing apparatus 21 is pulled out till the abutment section 122*b* of the auxiliary rail 122, the color erasing apparatus 21 can be prevented from suddenly falling off of the main body of the sheet processing apparatus 101.

Thus, after the stud 202 is contacted with the abutment section 122*b* and the color erasing apparatus 21 swivels about 90 degrees, the operator (user), when detaching the color erasing apparatus 21, can detach the color erasing apparatus 21 towards the direction in which the weight in the arrow D direction shown in FIG. 6 can be hardly felt. Further, as the color erasing apparatus 21 is prevented from suddenly falling off from the main body of the sheet processing apparatus 101, the security is improved during the replacement of the color erasing apparatus 21.

Figure 8:
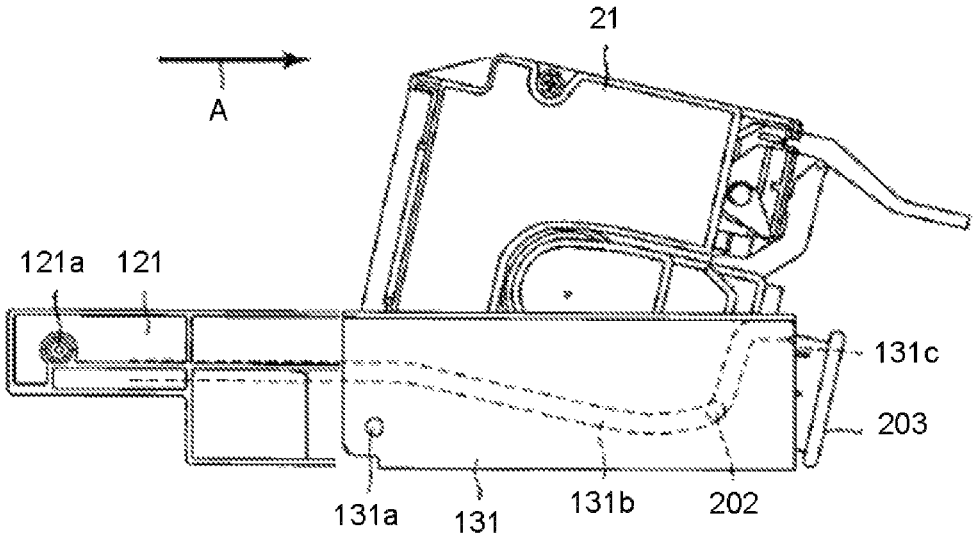
FIG. 8 shows another example of the guide mechanism of the heating apparatus.
Figure 9:
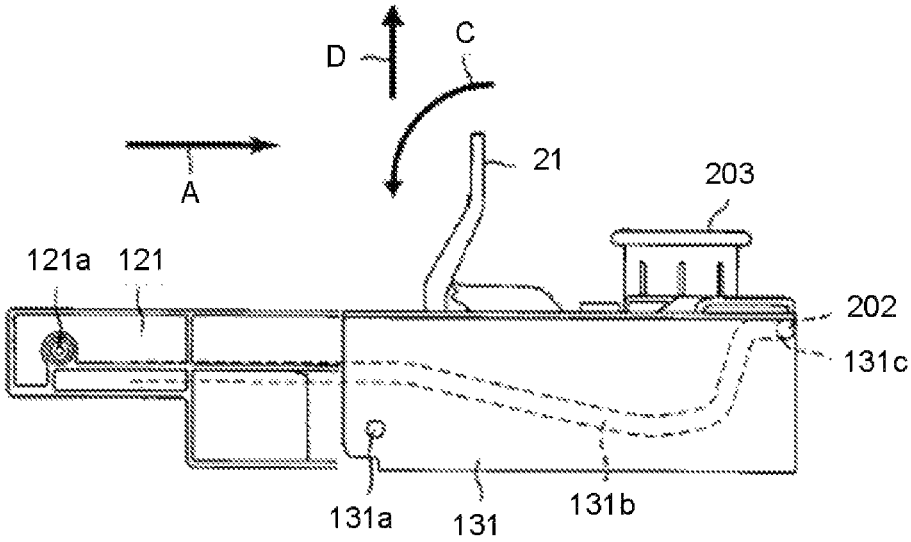
FIG. 9 shows another example of the guide mechanism of the heating apparatus.

An auxiliary rail 131 (marked as 131 to be distinguished from the auxiliary rail 121 described in the embodiment shown in FIG. 4-FIG. 6), may include a guide groove 131*b* for guiding the stud 202 of the color erasing apparatus 21, as shown in FIG. 8 and FIG. 9.

The auxiliary rail 131 shown in FIG. 8 and FIG. 9 is rotated about 90 degrees in the arrow B direction by taking the connection point at which the guide groove 131*b* is connected with the rail 121 extending in the arrow A direction, that is, the pivot point 131*a*, as a rotation center, so as to be substantially parallel to the rail 121 to guide the movement of the color erasing apparatus 21 in the spread auxiliary rail 131.

The guide groove 131*b* facilitates the detaching of the color erasing apparatus 21 from the rail 121 by guiding the color erasing apparatus generally in the arrow A direction in which the rail 121 extends, and also sloping down to utilize gravity in moving the color erasing apparatus.

The guide groove 131*b* has a terminal section 131*c* which is located nearby the end part of the auxiliary rail 131 and slopes up to slow down/stop movement from gravity on the color erasing apparatus 21.

More specially, the guide groove 131*b* enables the color erasing apparatus 21 to detach from the rail 121 easily by utilizing the weight of the color erasing apparatus 21. Further, the terminate section 131*c* prevents the color erasing apparatus 21 from damaging the end of the auxiliary rail 131 or flying off, by including a gradient on which a force substantially reverse to the gravity direction is acted.

Thus, the color erasing apparatus 21 moves along the guide groove 131*b* smoothly until reaching the terminal section 131*c*.

The color erasing apparatus 21, after reaching the terminal section 131*c*, rotates by taking the stud 202 as a rotation center about 90 degrees by its own weight in the arrow C direction, that is, the gravity direction in which the gravity is acted on. That is, in order to make the handle 203 face in the arrow D direction (a draw-out direction substantially orthogonal to the arrow A direction), the color erasing apparatus 21 swivels about 90 degrees.

By using the guide groove 131*b* such as that shown in FIG. 8 (FIG. 9), the color erasing apparatus 21 can be detached from the sheet processing apparatus 101 more safely and accurately.

Further, by leveling the terminal section 131*c* of the guide groove 131*b* (a shape restraining a free fall by the gravity), a state is provided in which the user (operator) temporarily feels no load of the color erasing apparatus 21, thus, the color erasing apparatus 21 can be detached or mounted more stably.

Figure 10:
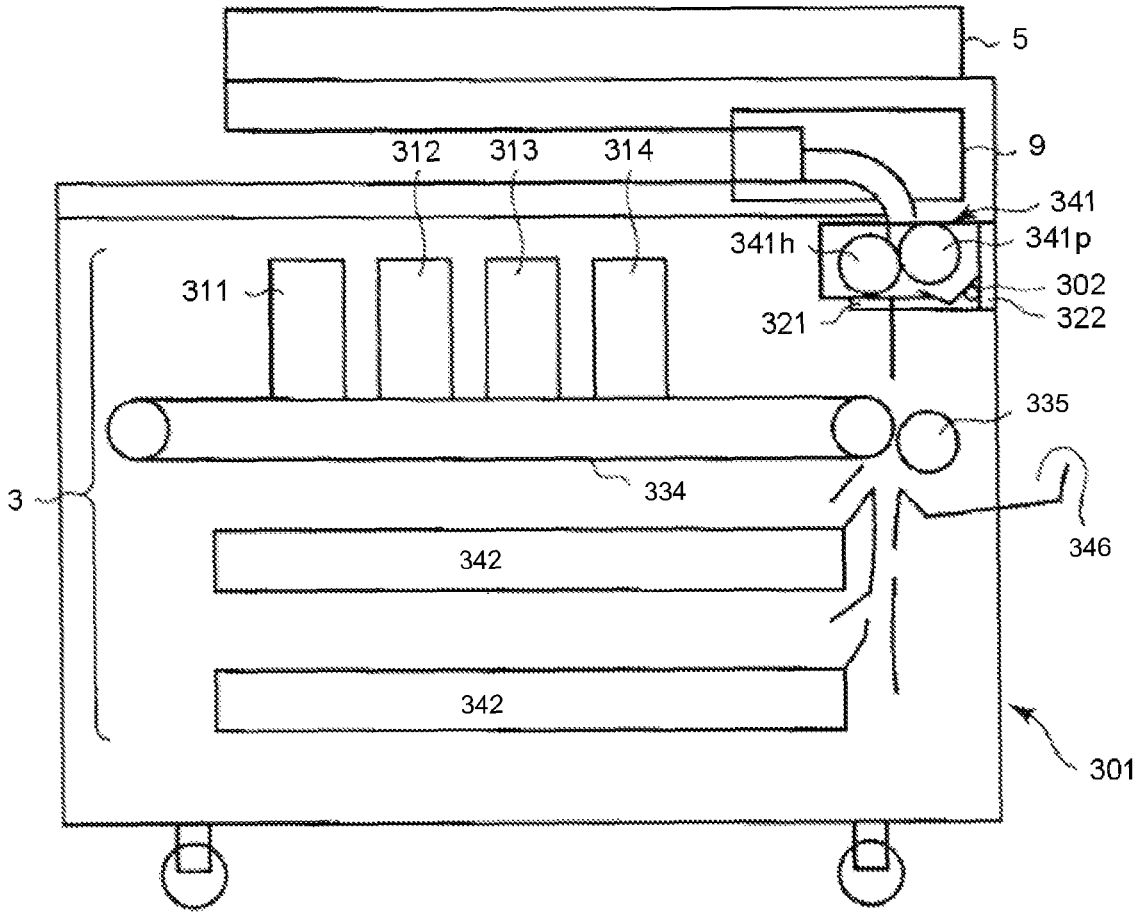
FIG. 10 shows an example of an image forming apparatus with the heating apparatus, according to the embodiment.

FIG. 10 shows an example of an image forming apparatus, that is, a fixing apparatus, in which the heating apparatus fixes a visualized image with a developing material, that is, a color material, on a sheet.

The image forming apparatus 301 shown in FIG. 10 comprises four image forming stations 311, 312, 313 and 314 for forming color images by forming four monochrome images with color materials of four colors cyan (C), magenta (M), yellow (Y) and black (Bk).

The four monochrome images are sequentially aligned along a transfer belt 334 and then transferred to a sheet fed from the cassette 342 in a transfer apparatus 335.

Figure 11:
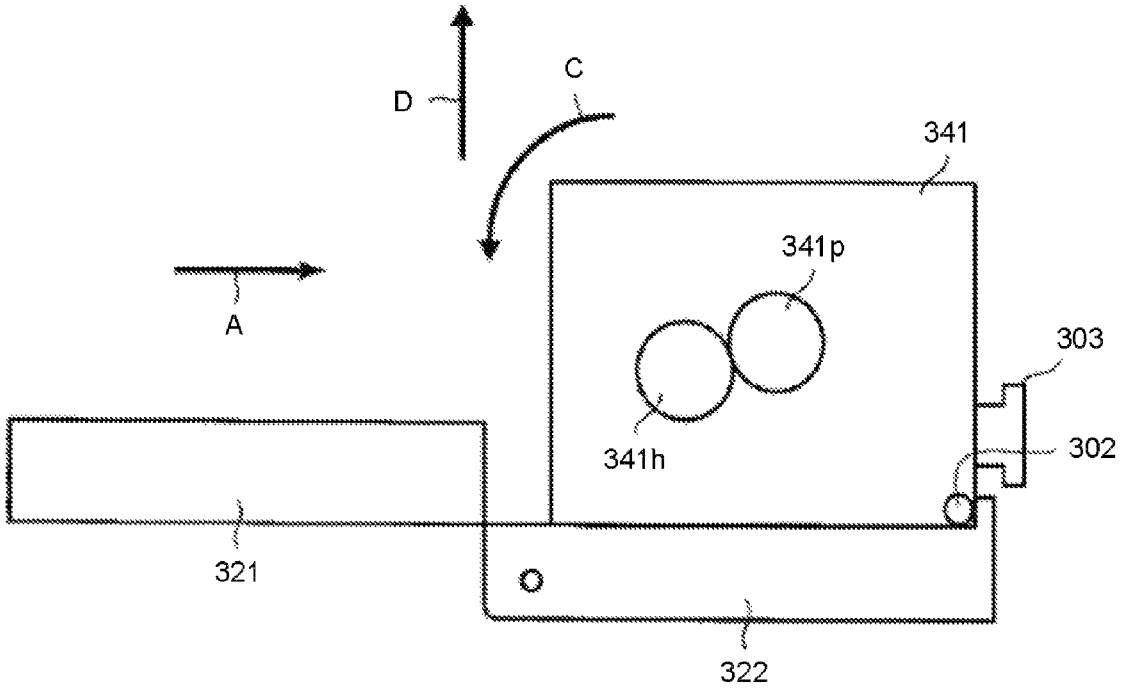
FIG. 11 shows an example of the guide mechanism of a heating apparatus of an embodiment.

The image on the sheet can be fixed on the sheet with the heat and a pressure from a fixing apparatus 341. If the fixing apparatus needs replacing or repair, the fixing apparatus 341 moves on the rail 321 and the auxiliary rail 322 which takes the pivot point 322*a* as a rotation center the structure of which is shown in FIG. 11 (identical to the rail 121 and the auxiliary rail 122 illustrated in FIG. 5 and FIG. 6), and is ended by contacting the stud section 302 with an abutment section as described above.

The fixing apparatus 341 moving to the abutment section on the auxiliary rail 322 rotates about 90 degrees by its own weight taking the stud 302 as a rotation center in the arrow C direction. That is, in order to make the handle 303 face in the arrow D direction (a draw-out direction substantially orthogonal to the arrow A direction), the fixing apparatus 341 swivels about 90 degrees. Thus, the fixing apparatus 341 can be easily drawn out in a draw-out direction. That is, the movement of a heavy object in the arrow D direction is favorable than the movement in the arrow A direction. Thus, the weight felt by an operator (user) who detaches the fixing apparatus 341 can be reduced.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing apparatus comprising:

a heating unit configured to heat a sheet when the sheet is conveyed between a pair of rollers;

a first guide unit configured to support and guide movement of the heating unit in a first direction towards an exterior of the sheet processing apparatus;

a second guide unit configured to support and guide further movement of the heating unit in the first direction in cooperation with the first guide unit and including an abutment section configured to stop movement of the heating unit in the first direction when the heating unit reaches a predetermined position at the exterior of the sheet processing apparatus; and at least one stud arranged on the heating unit and configured to contact the abutment section when the heating unit reaches the predetermined position, wherein, when the heating unit is at the predetermined position, the second guide unit does not support the heating unit at an end of the heating unit opposite the at least one stud so that the heating unit is allowed to rotate due to gravity, the weight of the heating unit causing the heating unit to rotate to a position in which the heating unit can be removed from the second guide unit in a substantially vertical direction.

2. The sheet processing apparatus according to claim 1, wherein the second guide unit is rotatable between a first position suitable for operation of the heating unit and in which the heating unit is prevented from moving in the first direction, and a second position for supporting and guiding movement of the heating unit in the first direction.

3. The sheet processing apparatus according to claim 2, further comprising a removable cover unit configured to cover the second guiding unit and the heating unit when the second guide unit is in the first position.

4. The sheet processing apparatus according to claim 1, wherein the at least one stud is configured to cooperate with the first and second guide units to support and guide movement of the heating unit in the first direction.

5. The sheet processing apparatus according to claim 1, wherein the second guide unit comprises a groove for supporting and guiding movement of the heating unit, the groove comprising:

a first portion for guiding movement of the heating unit in the first direction and inclined so that gravity assists in the movement, and a second portion for guiding movement of the heating unit to the predetermined position and inclined so that gravity opposes the movement.

6. The sheet processing apparatus according to claim 1, wherein the heating unit is configured to heat the sheet for at least one of a fixing process and an erasing process.

7. A method of removing a heating unit in a sheet processing apparatus, the heating unit including a pair of rollers for conveying and heating a sheet, the method comprising:

moving the heating unit in a substantially horizontal first direction towards an exterior of the sheet processing apparatus as the heating unit is supported and guided by a first guide unit;

moving the heating unit further in the first direction as the heating unit is supported and guided by a second guide unit in cooperation with the first guide unit until the movement of the heating unit is stopped in the first direction due to at least one stud on the heating unit contacting an abutment section on the second guide unit when the heating unit reaches a predetermined position in which the second guide unit does not support an end of the heating unit opposite the at least one stud;

when the heating unit is at the predetermined position, allowing the heating unit to rotate due to gravity, the weight of the heating unit causing the heating unit to rotate to a position in which the heating unit can be removed from the sheet processing apparatus in a substantially vertical direction; and removing the heating unit from the sheet processing apparatus, in the substantially vertical direction.

8. The method according to claim 7, further comprising:

before supporting and guiding movement of the heating unit, rotating the second guide unit from a first position suitable for operation of the heating unit and in which the heating unit is prevented from moving in the first direction, to a second position for supporting and guiding movement of the heating unit in the first direction.

9. The method according to claim 8, further comprising:

before rotating the second guide unit to the second position, removing a removable cover unit from the sheet processing apparatus, the removable cover configured to cover the second guiding unit and the heating unit when the second guide unit is in the first position.

10. The method according to claim 7, wherein the at least one stud is configured to cooperate with the first and second guide units to support and guide movement of the heating unit in the first direction.

11. The method according to claim 7, wherein the second guide unit comprises a groove for supporting and guiding movement of the heating unit, the groove comprising:

a first portion for guiding movement of the heating unit in the first direction and inclined so that gravity assists in the movement, and a second portion for guiding movement of the heating unit to the predetermined position and inclined so that gravity opposes the movement.

12. The method according to claim 7, wherein the heating unit is configured to heat the sheet for at least one of a fixing process and an erasing process.

13. An apparatus for facilitating removal of a heating unit from a sheet processing apparatus, the apparatus comprising:

a first guide unit configured to support and guide movement of the heating unit in a first direction towards an exterior of the sheet processing apparatus; and a second guide unit configured to support and guide further movement of the heating unit in the first direction in cooperation with the first guide unit and including an abutment section configured to stop movement of the heating unit in the first direction when the heating unit reaches a predetermined position at the exterior of the sheet processing apparatus, wherein the abutment section contacts at least one stud arranged on the heating unit when the heating unit reaches the predetermined position, wherein, when the heating unit is at the predetermined position, the second guide unit does not support the heating unit at an end of the heating unit opposite the at least one stud so that the heating unit is allowed to rotate due to gravity, the weight of the heating unit causing the heating unit to rotate to a position in which the heating unit can be removed from the second guide unit in a substantially vertical direction.

14. The apparatus according to claim 13, wherein the second guide unit is rotatable between a first position in which the heating unit is prevented from moving in the first direction, and a second position for supporting and guiding movement of the heating unit in the first direction.

15. The apparatus according to claim 14, wherein the second guide unit includes a groove configured to cooperate with the at least one stud on the heating unit to support and guide movement of the heating unit in the first direction.

16. The apparatus according to claim 15, wherein, when the second guide unit is in the first position, the groove is substantially vertically oriented, and when the second guide unit is in the second position, the groove is substantially horizontally oriented.

17. The apparatus according to claim 13, wherein the second guide unit includes a groove for supporting and guiding movement of the heating unit, the groove comprising:

a first portion for guiding movement of the heating unit in the first direction and inclined so that gravity assists in the movement, and a second portion for guiding movement of the heating unit to the predetermined position and inclined so that gravity opposes the movement.

18. The apparatus according to claim 13, wherein the second guide unit is configured to support the heating unit for removal in a substantially vertical direction, when the heating unit is at the predetermined position.

* * * * *